US007244371B2

(12) United States Patent
Fang et al.

(10) Patent No.: US 7,244,371 B2
(45) **Date of Patent: *Jul. 17, 2007**

(54) COMPOSITIONS AND METHODS FOR TREATING A TEXTILE USING SUCH COMPOSITIONS

(76) Inventors: Xinggao Fang, 388 Woodsberry Shoals Dr., Duncan, SC (US) 29334; Michelle Purdy, 2070 Pecan Dr., Spartanburg, SC (US) 29307; Shannon Williams, 273 Branchwood Dr., Liberty, SC (US) 29657; Kim Sasser, 206 South Pointe, Cowpens, SC (US) 29330

( * ) Notice: Subject to any disclaimer, the term of this patent is extended or adjusted under 35 U.S.C. 154(b) by 0 days.

This patent is subject to a terminal disclaimer.

(21) Appl. No.: 10/659,900

(22) Filed: Sep. 11, 2003

(65) Prior Publication Data

US 2005/0056805 A1 Mar. 17, 2005

(51) Int. Cl.

| | |
|---|---|
| ***D06M 10/00*** | (2006.01) |
| ***B32B 5/02*** | (2006.01) |
| ***B32B 27/04*** | (2006.01) |
| ***B32B 27/12*** | (2006.01) |

(52) U.S. Cl. ..... 252/8.62; 252/8.63; 442/79; 442/80; 442/83; 442/93; 442/94; 524/520; 524/544; 526/245

(58) Field of Classification Search ..... 252/8.62, 252/8.63; 442/79, 80, 82, 93, 94; 524/520, 524/544; 526/245

See application file for complete search history.

(56) References Cited

U.S. PATENT DOCUMENTS

| | | | | |
|---|---|---|---|---|
| 3,592,686 | A | 7/1971 | Barber et al. | 117/161 |
| 3,597,145 | A | 8/1971 | Marco | 8/115.6 |
| 3,598,514 | A | 8/1971 | Sello et al. | 8/115.6 |
| 3,598,515 | A | 8/1971 | Moore et al. | 8/115.6 |
| 4,014,857 | A * | 3/1977 | Schmoyer | 528/402 |
| 4,207,071 | A * | 6/1980 | Lipowitz et al. | 8/115.6 |
| 4,695,488 | A | 9/1987 | Hisamoto et al. | 427/385.5 |
| 5,747,392 | A | 5/1998 | Xiao et al. | 442/82 |
| 6,162,369 | A | 12/2000 | Allewaert et al. | 252/8.62 |
| 6,238,266 | B1 * | 5/2001 | Vogt | 450/19 |
| 6,239,247 | B1 | 5/2001 | Allewaert et al. | 528/49 |
| 6,251,210 | B1 * | 6/2001 | Bullock et al. | 156/272.2 |
| 6,383,633 | B1 | 5/2002 | Allewaert et al. | 428/375 |
| 6,492,001 | B1 | 12/2002 | Rubin et al. | 428/137 |
| 6,544,594 | B2 | 4/2003 | Linford et al. | 427/389.9 |
| 6,899,923 | B2 * | 5/2005 | Kimbrell et al. | 427/381 |
| 2004/0137154 | A1 * | 7/2004 | Kimbrell et al. | 427/385.5 |
| 2004/0137814 | A1 * | 7/2004 | Kimbrell et al. | 442/93 |
| 2004/0138083 | A1 * | 7/2004 | Kimbrell et al. | 510/392 |
| 2005/0062010 | A1 * | 3/2005 | Fang et al. | 252/8.62 |

OTHER PUBLICATIONS

REPEARL Product Information taken from http://www.micchem.com/products/Repearl (no date).*

* cited by examiner

*Primary Examiner*—Anthony J. Green
(74) *Attorney, Agent, or Firm*—Terry T. Moyer; Brenda D. Wentz

(57) ABSTRACT

Certain compositions provide excellent repellency, durability, and soil/stain release properties when applied to a textile or fabric. Such compositions may include: a repellent component, a hydrophilic resin component, a soil release component; and a crosslinking component. A method for applying such compositions to textiles also is disclosed.

9 Claims, No Drawings

COMPOSITIONS AND METHODS FOR TREATING A TEXTILE USING SUCH COMPOSITIONS

BACKGROUND OF THE INVENTION

Various compositions have been applied to textiles in an effort to achieve good repellency of such textiles when contacted with liquids, such as oils and water. Thus, it is desirable to provide textiles or fabric with repellency characteristics.

Furthermore, soil or stain release performance of textiles is important to textile consumers. Soil or stain release refers in general to the ability of a textile, once stained, to release the soil or stain upon laundering. In general, oil-based stains tend to remain in the textile within the textile fibers, which is highly undesirable. For example, oils which have not been repelled by the textile surface but have deposited into the textile are sometimes difficult to remove by routine washing procedures.

Stain resistant textile treatments are known. Commercially known products that have been used for such textile treating applications include, for example, Teflon® (produced by the DuPont Company of Wilmington, Del.), Scotchgard® (produced by 3M Company of Minneapolis, Minn.), and Nano-Pel® by Burlington Industries of North Carolina. These compositions, when applied to textiles, afford some degree of protection.

What is needed in the industry, however, are improved compositions that facilitate sufficient oil and water repellency in a textile application without sacrificing good soil and stain release from such textiles upon laundering. In particular, it would be desirable to provide a formulation for application to textiles that is capable of affording release of stains such as burned motor oil and transmission fluids, for example. This invention is directed to improved compositions and methods.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made the invention without departing from the scope or spirit of the invention.

Surprisingly, it has been discovered that certain specific compositions provide excellent repellency and soil/stain release when applied to a textile or fabric. In one embodiment of the invention the composition comprises at least the following: a repellent component, a hydrophilic resin component, a fluorinated soil release component, and a crosslinking component, as will be further described below.

Definitions and Terms

"Water repellency" and "oil repellency" are generally defined as the ability of a substrate to block water and oil from penetrating into the substrate, respectively. For example, the substrate may be a textile substrate which is capable of blocking water and oil from penetrating into the fibers of the textile substrate.

"Stain release" generally refers to the degree to which a stained substrate approaches its original, unstained appearance as a result of a care procedure.

The term "stain or soil resistant composition or stain or soil resistant treatment" as used herein refers to any treatment or composition that imparts stain resistance to fibers, particularly polyamide or cellulosic fibers.

"Durability" is generally defined as the ability of a substrate to retain an acceptable level of a desired function through a reasonable number of standard cleaning cycles. More specifically, durability, as described herein, describes a substrate that maintains adequate properties of stain resistance, water repellency, oil repellency, and soil release. This substrate may be a textile substrate, such as, for example, a polyester textile fabric, or alternatively may be a carpet, or yet another textile material.

The terms "fluorocarbons," "fluoropolymers," and "fluorochemicals" may be used interchangeably herein and each represents a polymeric material containing at least one fluorinated segment.

The term "padded" indicates that a liquid coating was applied to a substrate or textile by passing the substrate through a bath and subsequently through squeeze rollers.

"Hydrophilic" is defined as having a strong affinity for or the ability to absorb water.

"Hydrophobic" is defined as lacking affinity for or the ability to absorb water.

Repellent Component

There are numerous compositions that may be adapted to serve as the repellent component in the present invention. One that is particularly useful is a fluorochemical composition. Numerous fluorochemical compositions are known to be capable of achieving repellency on a fibrous substrate. The 3M Company produces a product line of fluorochemical compositions, including Scotchgard™ and the like, that can be employed. Furthermore, DuPont's Zonyl™ product line is also a candidate for the repellency component of the invention. Other products distributed by Daikin America, Inc. Chemical Company and Mitsubishi International Corporation, each of Japan could be employed, as well as others. REPEARL® F-8025, manufactured by Mitsubishi International Corporation may be used as well. Fluoroacrylates and urethane derivatives may be employed. Esters, acrylic amides, oligomers, and polymers also may be employed.

Hydropohilic Resin Component

Resins of various types may be employed in the application of the invention. These resins are typically hydrophilic, that is, having an affinity for aqueous solution. One group of such resins includes polyvinyl alcohol and derivatives, acrylate and methacrylate (co)polymers, (metha)acrylamide (co) polymers, polysaccharides and derivates, polyurethanes, polyesters, polyethers and combinations thereof. Others could also be employed, depending upon the specific formulation or textile substrate to be treated, including polyurethane-containing compounds and derivatives of anhydrides.

Soil Release Component

Soil (or stain) release agents, for example, may include ethoxylated polyesters, fluorinated esters, urethanes, acrylates, sulfonated polyesters, ethoxylated nylons, carboxylated acrylics, cellulose ethers or esters, hydrolyzed polymaleic anhydride polymers, polyvinylalcohol polymers, polyacrylamide polymers, fluorinated stain release polymers, ethoxylated silicone polymers, polyoxyethylene polymers, polyoxyethylene-polyoxypropylene copolymers, and the like, or combinations thereof. Specific commercially available examples of soil release components include, without limitation, Repearl SR-1100® (available from Mitsubishi International Corporation), Baygard SOC™ (Bayer Corporation); Zonyl 7910™, 9200™ (from Ciba Corporation), Unidyne TG-992™ and TG-993™ (Daikin Corporation), FC 248™ and PM 490™ (3M Company).

On the other hand, soil release components which are hydrophobic in nature may include waxes, silicones, certain hydrophobic resins, fluoropolymers, and the like, or combinations thereof. Fluoropolymers sometimes are ideal soil release components. In some applications, a given chemical component may serve as a hydrophilic resin and a soil release component. For example Astroclean 26A, described further below, is a hydrophilic resin and a soil release component.

Crosslinking Component

Cross-linking components also may be employed included in the invention, including those cross-linking components which are essentially insoluble in water, also known as hydrophobic. In other formulations, hydrophilic crosslinkers (sometimes called "extenders") may be quite useful.

In one embodiment of the invention, the use of crosslinking components comprised of one or more of the following may prove to be quite useful: melamine formaldehydes and derivatives, epoxides, and anhydrides and derivatives thereof. One such composition is EPI-REZ® 5003 W55, available from Shell.

In other embodiments, hydrophobic cross-linking components may include derivatives of isocyanates (such as blocked diisocyanates), polymers containing blocked isocyanates, epoxy containing compounds, and the like, or combinations thereof. Protected diisocyanate containing chemicals may be the suitable cross-linking components. However, chemicals containing two or more blocked isocyanate compounds may be the most preferred cross-linking components. One useful cross-linking component is REPEARL® MF, also available from Mitsubishi Corp. HYDROPHOBOL® XAN is another compound available from DuPont, which may be employed.

The total amount of the chemical composition applied to a substrate, as well as the proportions of each of the chemical components comprising the chemical composition, may vary over a wide range. The total amount of chemical composition applied to a substrate will depend generally on the composition of the substrate, the level of durability required for a given end-use application, and the cost of the chemical composition.

Concentration, Substrates, and Application Procedures

The composition may include ratio(s) of repellent component, hydrophilic resin, soil release component, and crosslinking component, respectively within the following range(s) of [about 1-10]:[about 1-10]:[about 1-10]:[about 1-10]. A more specific ratio that may be used is, respectively; 1-4:1-4:1-4:1-4.

It sometimes may be advantageous to employ a composition having a solids add on rate of between about 0.2% and about 10% by weight of the textile. In other applications, a solids add on rate of about 0.25% to about 2% may be used.

Chemical application may be accomplished by immersion coating, padding, spraying, foam coating, or by any other technique whereby one can apply a controlled amount of a liquid suspension to a textile substrate. Employing one or more of these application techniques may allow the composition to be applied to the textile substrate in a uniform manner. Many chemical treatments can be incorporated simultaneously with the chemical composition of the current invention, or such treatments may be carried out prior to treatment with the chemical composition of the current invention.

Substrates useful for receiving compositions of the present invention include many textile materials including, but not limited to woven, non-woven and knitted fabrics, and yarn or piece dyed upholstery woven fabrics, of natural fibers, synthetic fibers and mixtures of natural and synthetic fibers. Suitable natural fibers include, but are not limited to, fibers of cotton, linen, silk, wool and the like. Suitable synthetic fibers include, but are not limited to, fibers of polyamides (nylon), polyester, polyacrylic, rayon, acetate and the like. Compositions may be applied to either or both sides of the textile or fabric substrate.

Other Components and Compositions

Accordingly, it may be desirable optionally to treat the textile substrate with finishes containing additives or other chemicals such as antimicrobial agents, flame retardant agents, durable press resins, catalysts, lubricants, softeners, light stabilizers, antioxidants, coloring agents, antistatic agents, fragrances, and the like, or combinations thereof.

In one specific application of the invention, it may be advantageous to apply a fluorocarbon-containing repellent component, an acrylate or methacrylate-based hydrophilic resin, a fluorocarbon-containing soil release component, and a crosslinking component. The crosslinking component may be a derivative of isocyanate.

Methods and Procedures

Liquid or stain resistant properties of treated textiles may be measured using water and oil repellency tests.

Water Repellency was tested according to the 3M Water Repellency Test II (May, 1992). The rating scale is 0-10, with "0" indicating the poorest degree of repellency (substrates having higher surface energy) and "10" indicating the best degree of repellency (substrates having lower surface energy). The 3M water repellency scale is:

1 is 10% IPA, 90% water
2 is 20% IPA, 80% water
3 is 30% IPA, 70% water
4 is 40% IPA, 60% water
5 is 50% IPA, 50% water
6 is 60% IPA, 40% water
7 is 70% IPA, 30% water
8 is 80% IPA, 20% water
9 is 90% IPA, 10% water
10 is 100% IPA Oil Repellency was tested according to the MTCC Test Method 118-2000. The rating scale is 1-8, with "1" indicating the poorest degree of repellency (substrates having higher surface energy) and "8" indicating the best degree of repellency (substrates having lower surface energy). The oil repellency scale is:

1 is Nujol™ Mineral Oil
2 is 65/35 Nujol/n-hexadecane (by volume)
3 is n-hexadecane 4 is n-tetradecane
5 is n-dodecane
6 is n-decane
7 is n-octane
8 is n-heptane Soil or stain release property was measured using AATCC test method 130-1981. The wash temperature employed 140 Fahrenheit. The drying temperature was adjusted to "high". 90 grams of Tide® brand detergent was used in the washing procedure.

AATCC Test Method 130-1981

Soil Release: Oily Stain Release Method

Developed in 1969 by AATCC Committee RA56; reaffirmed 1970, 1974, 1977.

Editorially revised 1978, 1983, 1986; revised 1981.

1.Purpose and Scope 1.1 This test method is designed to measure the ability of a fabric to release oily stains during home laundering.

1.2 This test method is intended for the control of uniformity of soil release finishes during manufacture.

2.Principle 2.1 A stain on a test specimen is produced by using a weight to force a given amount of the staining substance into the fabric. The stained fabric is then laundered in a prescribed manner and the residual stain rated on a scale from 5 to 1 by comparison with a standard stain release replica showing a graduated series of stains.

3. Apparatus and Materials 3.1 AATCC White Textile Blotting Paper (see 10.1).

3.2 Mineral oil, refined (Nujol Brand) (see 10.2).

3.3 Glassine paper or equivalent (see 10.3).

3.4 Timer.

3.5 Weight, cylinder 6.4 cm (2.5 in.) dia., 2.268±0.045 kg (5±0.1 lb) (see 10.4).

3.6 Medicine dropper, straight.

3.7 Washer, automatic (see 10.5).

3.8 Dryer, automatic (see 10.6).

3.9 AATCC Standard Detergent 124 (with optical brightener) (see 10.4).

3.10 Ballast—92×92 cm (36×36 in.) hemmed pieces of cotton sheeting or 50/50 polyester cotton sheeting (see 10.7).

3.11 Lighting and evaluation area (see 10.8).

3.12 Table with "no-glare" black top 61×92 cm (24×36 in.); 92±3 cm (35±1 in.) high.

3.13 Stain Release Replica (see 10.9).

4. Test Specimens 4.1 Use three test specimens, 38×38 cm (15×15 in.), for each determination. Condition the test specimens for a minimum of four hours at 21±1 C (70±2 F) and 65±2% RH prior to application of stains.

5. Staining Procedure 5.1 Place the test specimen flat on a single thickness of AATCC Textile Blotting Paper on a smooth, horizontal surface.

5.2 Using a medicine dropper, place 5 drops (ea. 0.2 ml) Nujol Brand mineral oil (see 10.10) in the approximate center of the test specimen.

5.3 Place a 7.6×7.6 cm (3×3 in.) square of glassine paper over the oil puddle.

5.4 Place the five-pound weight directly over the glassine paper covering the oil puddle.

5.5 Allow the weight to sit undisturbed for 60 seconds.

5.6 Remove weight and discard the glassine sheet.

5.7 Do not allow stained test specimens to contact each other in a manner which would transfer stains. Wash within 15 to 60 minutes after staining.

6. Washing Procedure 6.1 Fill washer to high water levels with water at one of the temperatures from Table 1. Check with thermometer.

6.2 Add 140±5 grams (4.9±0.2 oz) AATCC Standard Detergent 124, or known equivalent, to washer.

6.3 Place test specimens and ballast in washer, making a total load equal 1.8±0.1 kg (4±¼ lb) (see 10.11 ).

6.4 Set the dial on the washer for a "Normal" wash to run for 12 minutes (measured time) and allow cycle to run to completion. (This gives normal agitation in both the wash and rinse).

6.5 At the end of the final spin cycle, place the entire load, test specimens and ballast, into the dryer.

6.6 Dry at the "High" setting, 70±6 C (160±10 F), maximum stack temperature, for 45±5 minutes.

6.7 Remove test specimens from dryer. Rate residual stains within four hours after drying.

TABLE 1

Washing Temperature Selection

| Washing Procedure | Temperature |
|---|---|
| I | 41 ± 3 C. (105 ± 5 F.) |
| II | 49 ± 3 C. (120 ± 5 F.) |
| III | 60 ± 3 C. (140 ± 5 F.) |

7. Evaluation 7.1 Mount the Stain Release Replica on the plywood mounting board, with the center of the standard 107 cm (45 in.) from the floor.

7.2 Place the test specimen flat in the center of the "no-glare" black topped table, with one edge of table touching mounting board.

7.3 Viewing distance shall be 76 cm (30 in.) from the back mounting board, with the eye at 157±15 cm (62±6 in.) from the floor.

7.4 Compare the residual stain on the test specimen with the stains in the Stain Release Replica.

8. Rating Procedure 8.1 Each judging individual should rate each test specimen for residual stain to nearest 0.5 rating according to Table II.

TABLE II

Stain Release Ratings

| | |
|---|---|
| Class 5 | Stain equivalent to Standard Stain 5. |
| Class 4 | Stain equivalent to Standard Stain 4. |
| Class 3 | Stain equivalent to Standard Stain 3. |
| Class 2 | Stain equivalent to Standard Stain 2. |
| Class 1 | Stain equivalent to Standard Stain 1. |

Class 5 represents the best stain removal and Class 1 the poorest stain removal.

9. Report 9.1 Calculate the average of nine ratings for each fabric (three judgements on each of three specimens) to nearest 0.1.

9.2 Indicate washing procedure used by appropriate Roman numeral from Table 1.

9.3 If stains other than the standard mineral oil are used, identify each stain and report the Stain Release Rating obtained for each stain separately.

10. Notes 10.1 AATCC White Textile Blotting paper. Available from AATCC, P.O. Box 12215, Research Triangle Park N.C. 27709.

10.2 Nujol is the trademark of Plough, Inc., for a refined mineral oil. It is available in most drug stores. Saybolt viscosity 360/390 at 38 C (100 F); specific gravity 0.880/0.900 at 15 C (60 F).

10.3 Rhinelander "Blu-White" window envelope glassine—24×36—25#/500. Packages of glassine paper containing a roll 45.7 m long by 30.5 cm wide (150 ft.×1 ft.) are available from AATCC, P.O. Box 12215, Research Triangle Park N.C. 27709.

10.4 Cylinder can be manufactured from stainless steel tubing.

10.5 Kenmore Automatic Washer Model 23801 has been accepted as the standard machine. Source: Sears, Roebuck & Co. For address of nearest Commercial Sales Department, write AATCC, P.O. Box 12215, Research Triangle Park N.C. 27709. Approved models of the Kenmore washer can often be found in local Sears, Roebuck & Co. retail stores. Any other washer which is known to give comparable results may be used.

10.6 Kenmore Automatic Dryer Model 65741 (electric) and Model 75741 (gas) have been accepted as the standard machines. The temperature controls are designed so that either the gas or electric models should give equivalent results. Source: Sears, Roebuck & Co. For address of nearest Commercial Sales Department, write AATCC, P.O. Box 12215, Research Triangle Park N.C. 27709. Approved models of the Kenmore dryers can often be found in local Sears, Roebuck & Co. retail stores. Any other dryer known to give comparable results may be used.

10.7 Source: Testfabrics, Inc., P.O. Box 420, Middlesex N.J. 08846.

10.8 Lighting and viewing area as described in AATCC Method 124 (Appearance of Durable Press Fabrics after Repeated Home Launderings); lighting equipment for viewing test specimens with overhead lighting. Place the black topped table with the 92 cm (36 in.) edge against the mounting board.

10.9 The Stain Release Replicas developed by the Deering Milliken Research Corporation are available from AATCC, P.O. Box 12215, Research Triangle Park N.C. 27709.

10.10 Although this test method presently calls for the use of only one standard stain, Nujol brand mineral oil, other non-standard staining substances of interest to the user, in addition to the standard oil, may be applied to the test specimens, using this same technique. In such case, the non-standard stain should be identified in the report.

10.11 The maximum number of test specimens shall be 30, with one stain per specimen, or a proportionately smaller number of test specimens if multiple stains are used on each specimen, e.g., 15 specimens with 2 stains each, etc. In any case, the maximum number of stains shall not exceed 30.

10.12 AATCC Standard Detergent, which is used in this test, is no longer typical of the many types of laundry detergents which are commercially available to the consumer, including for example Tide® detergent, made by Proctor and Gamble Corporation. Users of this method should be aware that currently marketed detergents may give results on fabrics which are different from those obtained with the Standard Detergent. For a more detailed discussion, see the section on AATCC Standard Detergent in this manual.

Components

Astroclean 26A™ is a hydrophilic acrylate copolymer made by Glo-tex Corporation.

For purposes of the Examples below, the catalyst employed is catalyst 531™ (from Omnova, Inc.) which is a aqueous magnesium chloride.

For purposes of the Examples below, Arkophob DAN® is a hydrophobic crosslinking component, which is a protected isocyanate, made by Clariant Corporation.

For purposes of the Examples below, Atebin 1062™ is a polyethylene sewing lubricant sold by Boehme Filatex Corporation.

EXAMPLE 1

Soil Release Component

Hydrophilic Component

Repellent Component, and

Crosslinking Component

A piece of woven nylon/cotton textile was immersed in a chemical bath that contains on weight of bath:

3% Astroclean 26A
3% Unidyne TG-992
1% of Repearl F8025
2.5% of Arkophob DAN
6% of Permafresh MFX
1.5% of Catalyst 531
1% of Atebin 1062.

The fabric was passed through a nip of two rolls with a wet pickup of about 50-70% under about 40 psi pressure. The fabric was finally heated to 360 Fahrenheit for approximately 4.5 minutes in an oven to remove moisture.

EXAMPLE 2

Soil Release Component

Hydrophilic Component

Repellent Component, and Crosslinking Component

Same as Example 1 except that 2% Astraclean 26A, 4% of Unidyne TG-992 and 1% of Unidyne TG-5010 were used to replace the first three chemicals in Example 1.

EXAMPLE 3

Control

Same as Example 1 except that only three substituents: 8% of Permafresh MFX, 2% of Catalyst 531 and 1% of Atebin 1062 were used. This serves as a control for comparative purposes.

EXAMPLE 4

Repellent Component,

Soil Release Component, and

Crosslinking Component

Same as Example 1 except that 4.5% Unidyne TG-992, 1% of Repearl F8025, 1.5% of Arkophob DAN, 6% of Permafresh MFX, 1.5% of Catalyst 531 and 1% of Atebin 1062 were used.

EXAMPLE 5

Soil Release Component, and

Crosslinking Component

Same as Example 1 except that 6% Unidyne TG-992, 1.5% of Arkophob DAN, 6% of Permafresh MFX, 1.5% of Catalyst 531 and 1% of Atebin 1062 were used.

TABLE 3

Testing Results of Textile Substrate Treated with Inventive Composition

| | Examples | | | | |
|---|---|---|---|---|---|
| | #1 | #2 | #3 | #4 | #5 |
| Oil Repellency: 0 Wash | x | x | x | x | x |
| Water Repellency: 0 Wash | x | x | x | x | x |
| Burned Motor Oil Release: 0/1 | 3.5 | 4 | 1 | 3.5 | 3.5 |
| Transmission Fluid Release: 0/1 | 4 | 4 | 1 | 3.5 | 4 |
| Oil Repellency: 5 Wash | | | x | 4 | |
| Water Repellency: 5 Wash | | | x | 4 | |
| Burned Motor Oil Release: 4/5 | 3.5 | 3.5 | 1 | 1 | 3.5 |
| Transmission Fluid Release: 4/5 | 4 | 3.5 | 1 | 3 | 3.5 |
| Oil Repellency: 10 Wash | 4 | 4 | x | x | 4 |
| Water Repellency: 10 Wash | 5 | 4 | x | x | 4 |
| Burned Motor Oil Release: 9/10 | 3.5 | 3.5 | 1 | x | 2.5 |
| Transmission Fluid Release: 9/10 | 3.5 | 3.5 | 1 | x | 3 |

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A composition comprising:

(a) a first fluorine-containing component, wherein said first fluorine-containing component provides repellent properties to a textile substrate;

(b) a hydrophilic resin, wherein said hydrophilic resin comprises a polyurethane-containing compound;

(c) a second fluorine-containing component, wherein said second fluorine-containing component provides soil release properties to a textile substrate; and (d) a crosslinking component.

2. The composition of claim 1 wherein said first fluorine-containing component is selected from the group consisting of fluoroacrylates, urethane derivatives, esters, acrylic amides, oligomers, and polymers.

3. The composition of claim 2 wherein said first fluorine-containing component comprises a fluoroacrylate.

4. The composition of claim 1 wherein said crosslinking component is selected from the group consisting of derivatives of melamine formaldehydes, epoxides, derivatives of isocyanates, and anhydrides.

5. The composition of claim 4 wherein said crosslinking component comprises a derivative of isocyanate.

6. The composition of claim 1 wherein said crosslinking component is hydrophobic.

7. The composition of claim 1 wherein the ratio of (a):(b):(c):(d) is within the following range: [about 1-10]:[about 1-10]:[about 1-10]:[about 1-10].

8. The composition of claim 1 additionally comprising an additive component, said additive component being selected from the group of additives consisting of durable press resins, catalysts, lubricants, softeners, antimicrobial agents, antistatic agents, flame retardant agents, and light stabilizers.

9. A textile containing the composition of claim 1.

* * * * *